US011664563B2

(12) United States Patent
Deng et al.

(10) Patent No.: US 11,664,563 B2
(45) **Date of Patent: *May 30, 2023**

(54) FILTERING DEVICE

(71) Applicant: HUAWEI TECHNOLOGIES CO., LTD., Shenzhen (CN)

(72) Inventors: Liangyong Deng, Dongguan (CN); Dantao Cai, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 71 days.

This patent is subject to a terminal disclaimer.

(21) Appl. No.: 17/325,958

(22) Filed: May 20, 2021

(65) Prior Publication Data

US 2021/0344091 A1 Nov. 4, 2021

Related U.S. Application Data

(63) Continuation of application No. 16/435,552, filed on Jun. 9, 2019, now Pat. No. 11,043,724, which is a continuation of application No. PCT/CN2016/109315, filed on Dec. 9, 2016.

(51) Int. Cl.

| | |
|---|---|
| ***H01P 1/203*** | (2006.01) |
| ***H01P 7/08*** | (2006.01) |
| ***H01P 1/207*** | (2006.01) |

(52) U.S. Cl.

CPC ..... *H01P 1/203* (2013.01); *H01P 1/207* (2013.01); *H01P 7/088* (2013.01)

(58) Field of Classification Search

CPC .. H01P 1/203; H01P 1/207; H01P 7/08; H01P 7/084; H01P 7/088

USPC ..... 333/205, 204

See application file for complete search history.

(56) References Cited

U.S. PATENT DOCUMENTS

| | | | | |
|---|---|---|---|---|
| 3,343,069 | A | 9/1967 | Tsuda | |
| 5,028,896 | A | 7/1991 | Kuokkanen | |
| 5,225,799 | A | 7/1993 | West | |
| 5,352,996 | A | 10/1994 | Kawaguchi | |
| 6,078,231 | A | 6/2000 | Pelkonen | |
| 11,043,724 | B2 * | 6/2021 | Deng | H01P 7/088 |
| 2010/0007442 | A1 | 1/2010 | Narhi | |
| 2011/0140805 | A1 | 6/2011 | Liu et al. | |

(Continued)

FOREIGN PATENT DOCUMENTS

| | | | |
|---|---|---|---|
| CN | 101438457 | A | 5/2009 |
| CN | 102694220 | A | 9/2012 |

(Continued)

*Primary Examiner* — Stephen E. Jones

(74) *Attorney, Agent, or Firm* — Paul Christopher Hashim

(57) ABSTRACT

Embodiments provide a filtering device, to effectively simplify assembly and tuning processes. The filtering device includes: a housing, including an inner cavity; a resonant conductor, having a resonance function, and disposed inside the inner cavity; and a pressing element, having one end disposed on the housing and another end suspended, and facing a position of an open-circuit end of the resonant conductor. A distance between the pressing element and the resonant conductor is changeable when the pressing element is pressed or drawn to adjust a resonant frequency. The filtering device provided in various embodiments is applicable to a plurality of communications devices for selecting a signal frequency.

13 Claims, 5 Drawing Sheets

(56) References Cited

U.S. PATENT DOCUMENTS

| | | | |
|---|---|---|---|
| 2015/0061793 | A1 | 3/2015 | Zhou et al. |
| 2016/0204493 | A1 | 7/2016 | Park et al. |
| 2017/0141446 | A1 | 5/2017 | Tkadlec |

FOREIGN PATENT DOCUMENTS

| | | | |
|---|---|---|---|
| CN | 103004013 | A | 3/2013 |
| CN | 103035988 | A | 4/2013 |
| CN | 104126247 | A | 10/2014 |
| CN | 106711558 | A | 5/2017 |
| EP | 2475098 | A2 | 7/2012 |
| EP | 3079200 | A1 | 10/2016 |
| JP | S54143045 | A | 11/1979 |
| WO | 2016068512 | A1 | 5/2016 |

* cited by examiner

FILTERING DEVICE

CROSS-REFERENCE TO RELATED APPLICATIONS

This application is a continuation of U.S. patent application Ser. No. 16/435,552, filed on Jun. 9, 2019, which is a continuation of International Application No. PCT/CN2016/109315, filed on Dec. 9, 2016. All of the aforementioned patent applications are hereby incorporated by reference in their entireties.

TECHNICAL FIELD

Embodiments of this application relate to the field of communications technologies, and in particular, to a filtering device.

BACKGROUND

Filters are widely applied to a microwave communication system, a radar navigation system, an electronic countermeasure system, a satellite communications system, a missile guidance system, a meter testing system, and the like. As development of communications, more channels can be selected by a system. This imposes higher requirements on design of the filter. In addition, the filter is an important part of a communications system, and performance of the filter greatly influences quality of the communications system.

The filter is a device with a frequency selection function that allows a specific frequency component in a signal to pass through while greatly attenuating other frequency components, thereby filtering out interference. There are many types of filters. A cavity filter, because of its features of high power, a low loss, and a robust structure, availability for a microwave frequency band, and the like, is widely applied to various communications systems. In addition, communication frequency bands are increasingly high, operating bandwidth is becoming wider, and an advantage of the cavity filter is getting obvious.

Performance indicators and reliability of the cavity filter have a strong correlation with the structure of the cavity filter. An existing cavity filter includes a cavity, a cover, and a tuning screw. The cover is usually fastened to the cavity by using the screw, and a degree of fastening thereof is uncontrollable, directly affecting filter frequency selectivity. In addition, the tuning screw is mounted on the cover, and it is relatively time-consuming to adjust a resonance characteristic of the filter by screwing the tuning screw. Assembly and tuning processes of the filter are complex.

SUMMARY

In view of this, embodiments of this application provide a filtering device, to effectively simplify assembly and tuning processes.

According to a first aspect, a filtering device is provided. The filtering device includes:

a housing, including an inner cavity;

a resonant conductor, disposed inside the inner cavity; and a pressing element, having one end disposed on the housing and another end suspended, and facing a position of an open-circuit end of the resonant conductor, where a distance between the pressing element and the resonant conductor is changed by pressing or drawing, to adjust a resonant frequency.

Optionally, the filtering device further includes:

a cavity terminal, configured to electrically connect a short circuit end of the resonant conductor to the housing, and further configured to support the resonant conductor.

Further, the resonant conductor is disposed inside the cavity by inserting and removing. The resonant conductor is vertically or horizontally disposed inside the inner cavity.

Optionally, the resonant conductor is a metal strip, a microstrip, a strip line, or a printed circuit board (PCB).

Optionally, the housing includes at least one inner cavity, and at least one resonant conductor is disposed inside the inner cavity. Resonant conductors in different inner cavities are electrically connected by using a metal pin, a metal probe, or a printed circuit board.

Optionally, the pressing element is of a metal sheet-shaped structure. Optionally, the pressing element may be of a metal peg-shaped structure.

Optionally, the filtering device further includes:

a fastening terminal, disposed on an outer side of the housing, and configured to fasten the filtering device; and a wiring port, disposed on an outer side of the housing, and configured to connect to a wire.

The pressing element, the cavity terminal, the fastening terminal, or the wiring port described above is integrally formed with the housing. For example, a profile housing or an integral model is used.

Optionally, the pressing element, the cavity terminal, the fastening terminal, or the wiring port is not integrally formed with the housing. For example, the foregoing component may be connected to the housing by welding.

It can be learned that, based on the housing provided in this application, complex steps of mounting a cover and walls can be omitted. The resonant conductor is inserted into and removed from the inner cavity of the housing. This facilitates an adjustment or replacement of the resonant conductor. The pressing element provided in this application is closely connected to the housing, and the resonant frequency is adjusted by pressing or drawing, thereby simplifying a tuning method. In conclusion, it can be learned that the filtering device provided in this application effectively simplifies the assembly and tuning processes.

BRIEF DESCRIPTION OF DRAWINGS

To describe the technical solutions in the embodiments of this application more clearly, the following briefly describes the accompanying drawings required for describing the embodiments or the prior art. Apparently, the accompanying drawings in the following description show merely some embodiments of this application, and a person of ordinary skill in the art may still derive other drawings from these accompanying drawings without creative efforts.

DESCRIPTION OF EMBODIMENTS

The following describes the technical solutions in the embodiments of this application with reference to the accompanying drawings in the embodiments of this application. Apparently, the described embodiments are merely some rather than all of the embodiments of this application. All other embodiments obtained by a person of ordinary skill in the art based on the embodiments of this application without creative efforts shall fall within the protection scope of this application.

"A plurality" refers to two or more than two. The term "and/or" describes an association relationship for describing associated objects and represents that three relationships may exist. For example, A and/or B may represent the following three cases: Only A exists, both A and B exist, and only B exists. The character "/" generally indicates an "or" relationship between the associated objects.

The terms in this application are described above, to facilitate understanding by a person skilled in the art.

Figure 1:
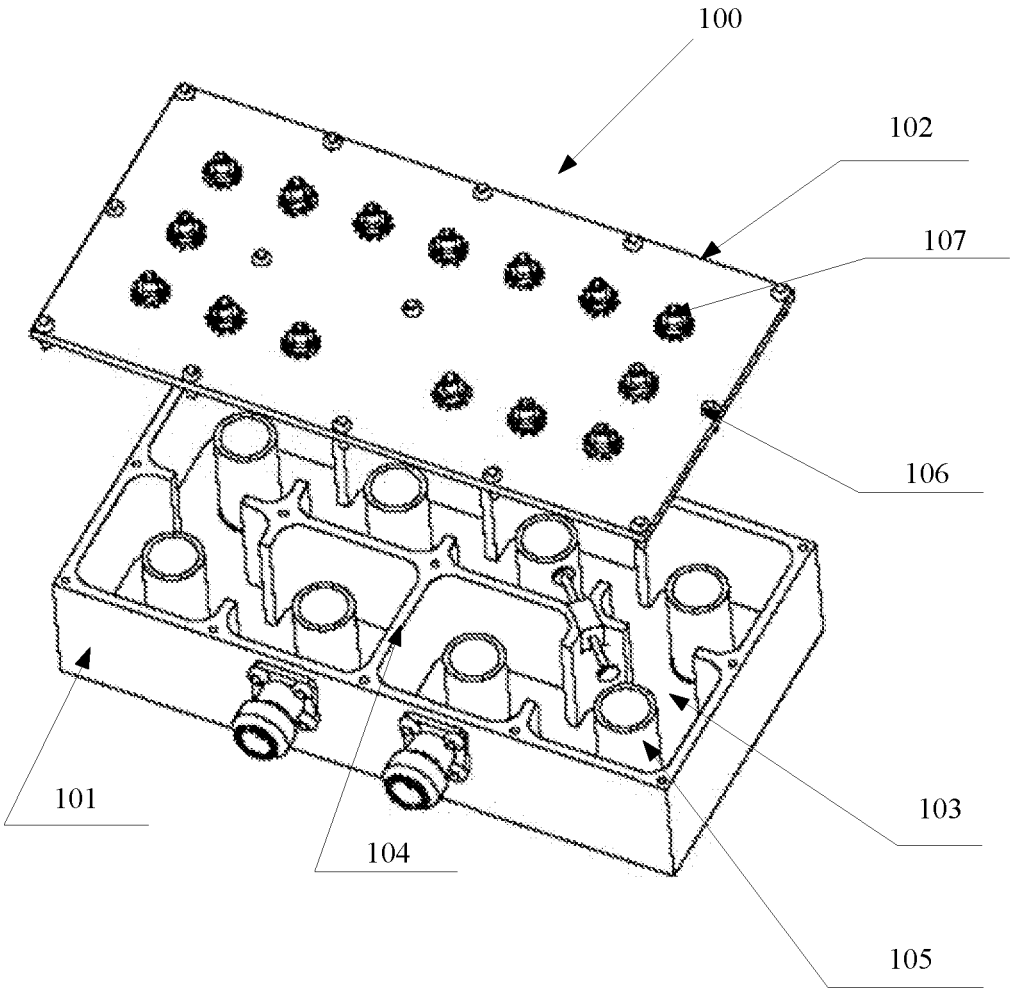
FIG. 1 (Prior Art)
FIG. 1 is a schematic structural diagram of a filter 100 in the prior art.

FIG. 1 is a schematic structural diagram of a filter 100 in the prior art. As shown in FIG. 1, the filter 100 in the prior art includes: a cavity 101, a cover 102, a support member 104, a resonant element 105, a fastening screw 106, a tuning screw lever 107, and the like. There are one or more single resonant cavities 103 in the cavity 101. The cavity 101 may be formed as an integral component by machining or casting, and the cover 102 is formed by casting or by machining using a molding plate. During assembly, the support member 104 is first assembled as a component to be fastened inside the cavity 101. Next, the resonant element 105 is fastened at a central position of the single resonant cavity 103 in the cavity 101 to form a resonant unit. Then, the tuning screw lever 107 is fastened on the cover 102. Finally, a cover component and a cavity component that are assembled are mounted together by using the fastening screw 106.

It can be learned that, a manufacturing and assembly process of the existing filter is relatively complex, and resonance performance of the filter may be affected by a degree of fastening between the cover 102 and the cavity 101, and may also be affected by stability of grounding of the tuning screw lever 107. In addition, it is relatively time-consuming to implement tuning by screwing the tuning screw lever 107.

In view of this, an embodiment of this application provides a filter (which is also referred to as a filtering device) that can simplify an assembly process and a tuning process, and can effectively improve filtering performance of the filter.

The filtering device provided in this embodiment of this application is applicable to various communications systems, for example, 2G communications systems such as a Global System for Mobile Communications (GSM) and a general packet radio service (GPRS) system; 3G communications systems such as a Code Division Multiple Access (CDMA) system, a Time Division Multiple Access (TDMA) system, a Wideband Code Division Multiple Access (WCDMA) system; and a Long Term Evolution (LTE) system and an LTE-Advanced system.

The filtering device provided in some embodiments of this application is applicable to a plurality of communications devices that need to select a signal frequency, for example, may be used in a base station device.

Figure 2:
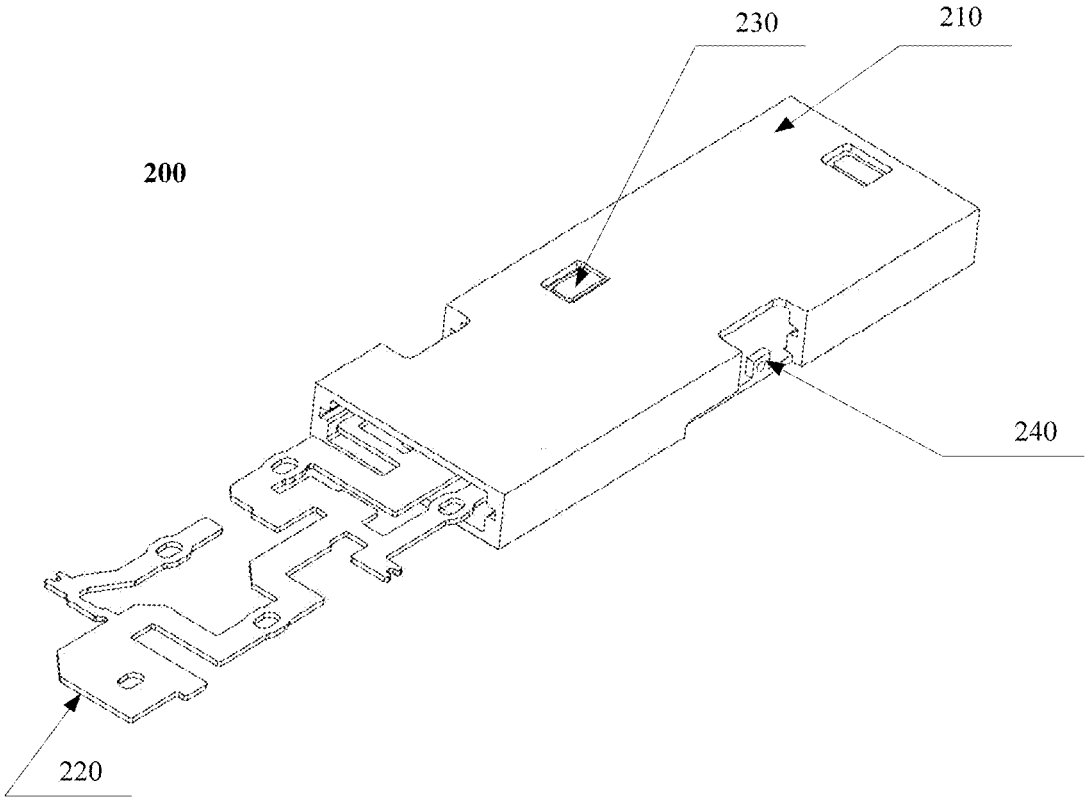
FIG. 2 is a schematic structural diagram of a filtering device according to an embodiment of this application.

FIG. 2 is a schematic structural diagram of a filtering device 200 according to an embodiment of this application. The filtering device 200 includes:

a housing 210, including an inner cavity;

a resonant conductor 220, disposed inside the inner cavity; and a pressing element 230, having one end disposed on the housing and another end suspended, where the pressing element 230 facing a position of an open-circuit end of the resonant conductor, and a distance between the pressing element 230 and the resonant conductor 220 is changed by pressing or drawing the pressing element 230, to adjust a resonant frequency.

In some embodiments, as shown in FIG. 2, the filtering device further includes a cavity terminal 240, configured to electrically connect a short circuit end of the resonant conductor 220 to the housing 210, and further configured to support the resonant conductor. When the filtering device shown in FIG. 2 has no cavity terminal 240, another replaceable support element may be used to electrically connect the resonant conductor to the housing by welding.

Based on the foregoing structure, in a process of assembling the filtering device, a cover does not need to be assembled, an assembly process of the filtering device is simple, and impact of assembly of the cover on performance of the filtering device is reduced. In addition, tuning can be implemented by pressing or drawing the pressing element 230, thereby simplifying a tuning process, and reducing a tuning time.

Figure 3:
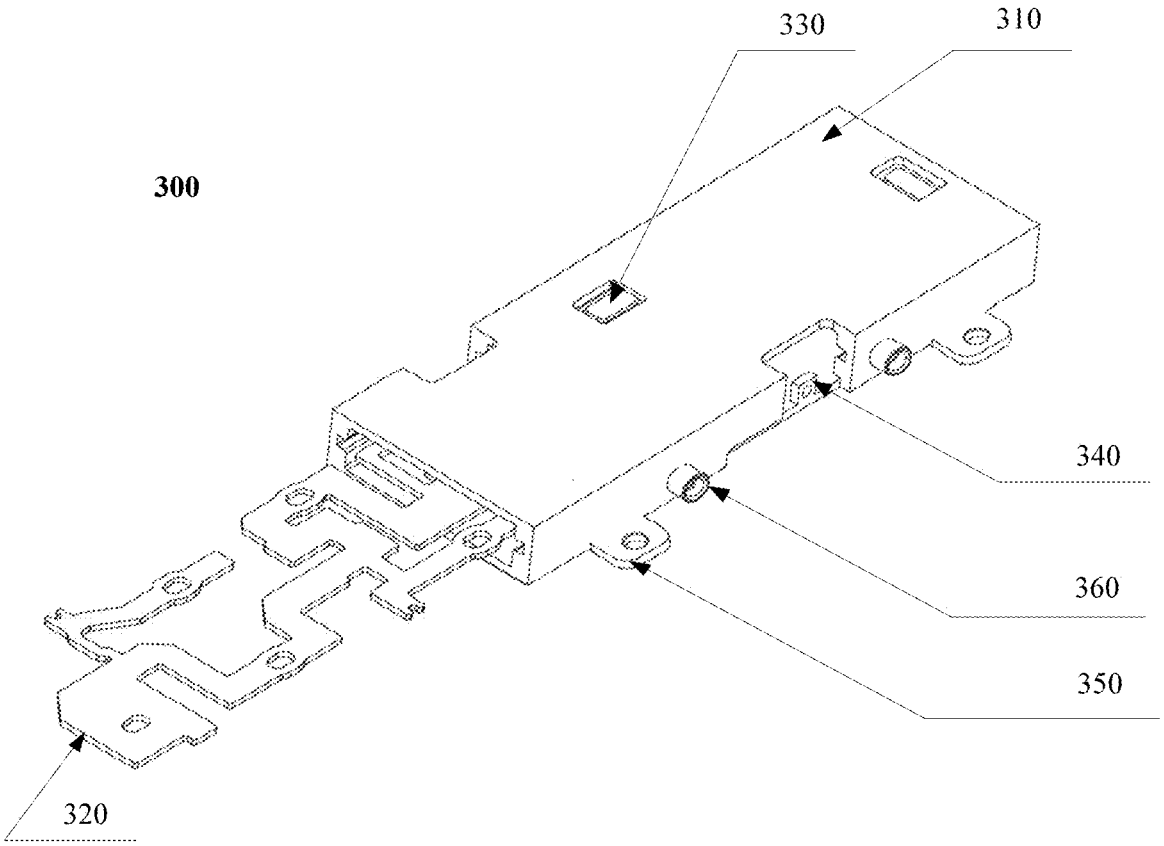
FIG. 3 is a schematic structural diagram of a filtering device according to an embodiment of this application.

FIG. 3 is a schematic structural diagram of an example filtering device 300 in accordance with the disclosure. As shown in FIG. 3, in addition to a housing 210, a resonant conductor 220, and a pressing element 230 that are included in the filtering device shown in FIG. 2, and an cavity terminal 340 is included in the filtering device 300. In this example, the filtering device 300 also includes:

a fastening terminal 350, disposed on an outer side of the housing, and configured to fasten the filtering device; and a wiring port 360, disposed on an outer side of the housing, and configured to connect to a wire.

It can be learned that for the filtering device 300 having the fastening terminal and the wiring port, it can be very convenient to fasten the filtering device on another device, and it is convenient to connect to a signal input or output wire.

Figure 4:
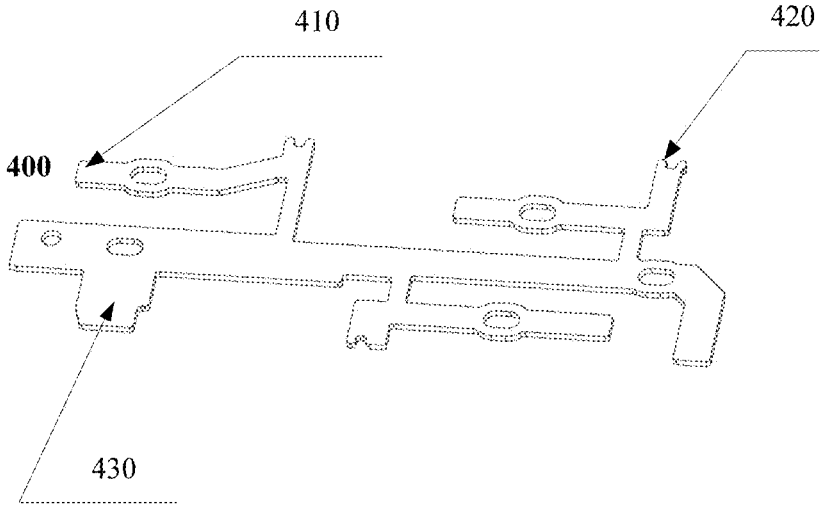
FIG. 4 is a schematic structural diagram of a resonant conductor according to an embodiment of this application.

The following further describes, with reference to FIG. 4 that is a schematic diagram of a resonant conductor 400 according to an embodiment, a structure of the resonant conductor 400. As shown in FIG. 4, the resonant conductor 400 includes:

an open-circuit end 410, configured to assist a pressing element in adjusting a resonance characteristic;

a short circuit end 420, configured to be grounded, where the short circuit end 420 may be optionally grounded by using a cavity terminal; and a wiring end 430, configured to connect to a wire to output a signal or input a signal, and further configured to connect to a wiring port such as the wiring port 360 in FIG. 3.

The resonant conductor 400 may be disposed inside an inner cavity of a filtering device by inserting and removing. In the filtering device shown in FIG. 2 or FIG. 3, the resonant conductor is horizontally disposed inside the inner cavity. In some other embodiments, the resonant conductor may be vertically disposed inside the inner cavity. Details are not described herein.

It should be noted that the resonant conductor 400 is merely an example, and a quantity of open-circuit ends, a quantity of short circuit ends, and a quantity of wiring ends are not limited herein. The resonant conductor 400 is a conductor with resonance performance, for example, may be a metal strip, a microstrip, a strip line, or a printed circuit board (PCB). A specific implementation form of the resonant conductor is not limited herein.

Figure 5:
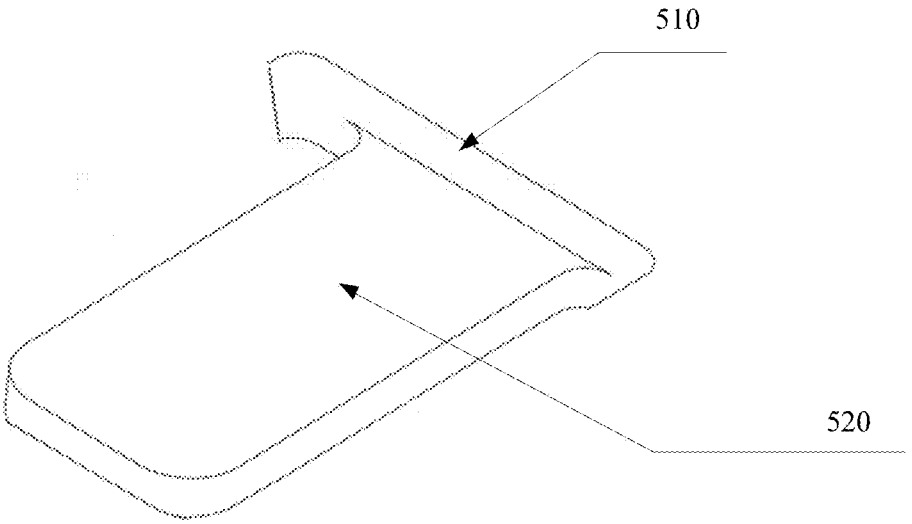
FIG. 5 is a schematic structural diagram of a pressing element according to an embodiment of this application.

The following further describes, with reference to FIG. 5 that is a schematic structural diagram of a pressing element 500 according to one embodiment, a structure of the pressing element 510. As shown in FIG. 5, in this embodiment, the pressing element 510 is of a sheet-shaped structure having one end disposed on a housing 510, and other three ends suspended.

Figure 6:
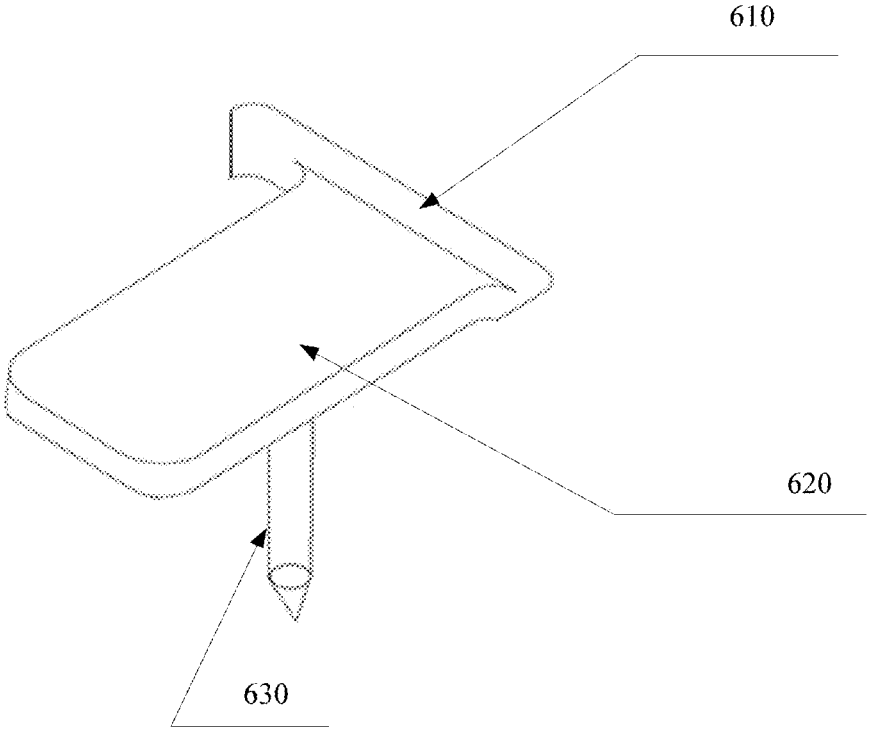
FIG. 6 is a schematic structural diagram of another pressing element according to an embodiment of this application.

FIG. 6 is a schematic diagram of another pressing element according to the present disclosure. As shown in FIG. 6, the pressing element 600 is of a pin-shaped structure, including a pin cap 620 and a pin bar 630, and is connected to a housing 610 of the filtering device by using the pin cap 620 of the pin-shaped structure, and extends into an inner cavity of the housing by using the pin bar 630 of the pin-shaped structure.

It should be noted that the foregoing pressing element is merely an example, and a specific shape of the pressing element is not limited in this application. Any variation or replacement readily figured out by a person skilled in the art within the technical scope disclosed in this application shall fall within the protection scope of this disclosure. Any method for adjusting a resonance characteristic by pressing or drawing a pressing element shall fall within the protection scope of this disclosure.

Figure 7:
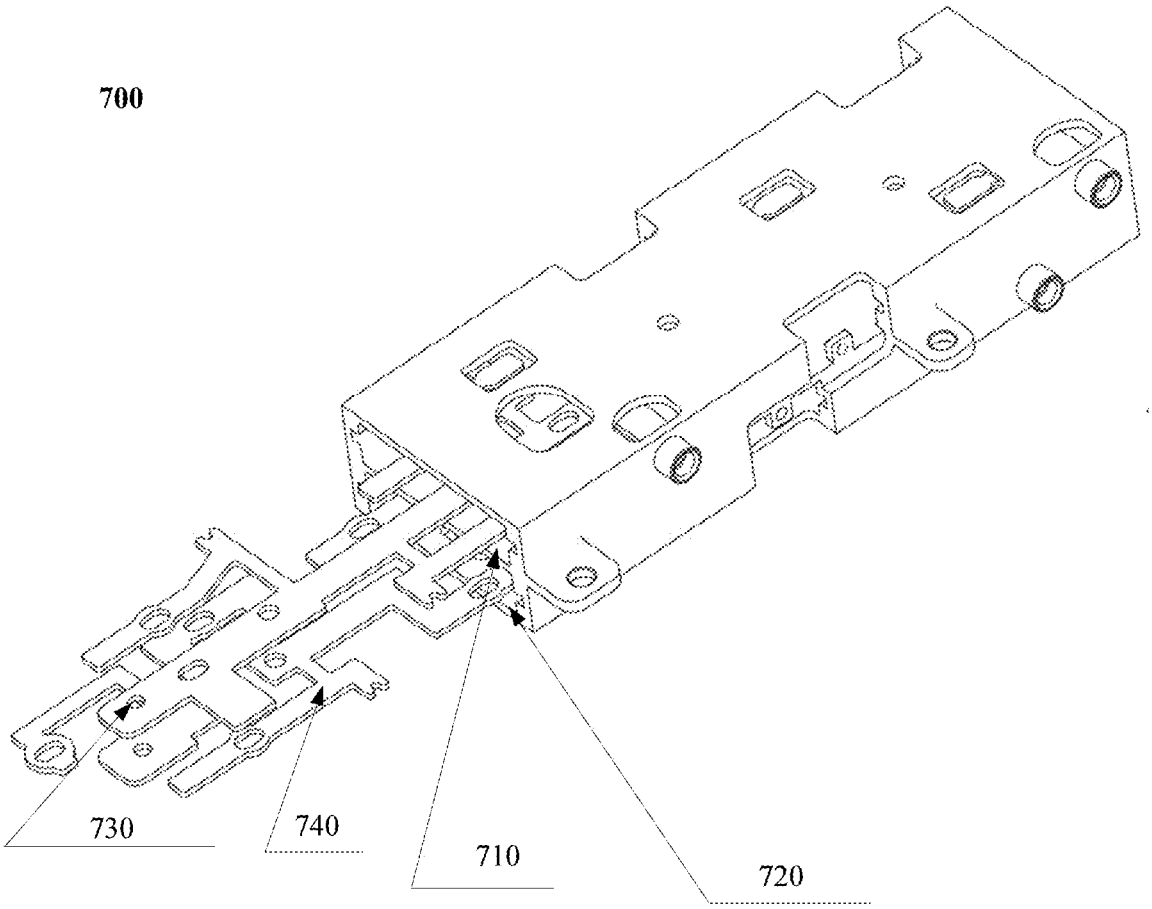
FIG. 7 is a schematic structural diagram of a filtering device according to an embodiment of this application.

For the filtering device shown in the foregoing embodiment, a housing including one inner cavity is used as an example. In some embodiments, the housing may include a plurality of inner cavities, such as a combiner. FIG. 7 is a schematic structural diagram of another filtering device 700 according to an embodiment of this application. As shown in FIG. 7, the filtering device 700 has a housing including two inner cavities, such as an inner cavity 710 and an inner cavity 720 in FIG. 7. One resonant conductor is disposed inside each inner cavity, that is, a resonant conductor 730 is disposed inside the inner cavity 710, and a resonant conductor 740 is disposed inside the inner cavity 720. For other components such as a pressing element and a cavity terminal, refer to FIG. 2. Details are not described herein.

When the housing includes a plurality of inner cavities, resonant conductors in the plurality of inner cavities may be electrically connected. For example, the electrical connection is implemented by using a metal pin, a metal probe, or a printed circuit board PCB. For example, the resonant conductor 730 and the resonant conductor 740 in FIG. 7 may be electrically connected by using a metal pin, a metal probe, or a PCB.

It should be noted that in the filtering device 700 in the foregoing embodiment, only a case in which one resonant conductor is disposed inside each inner cavity is illustrated. Optionally, a plurality of resonant conductors may be disposed inside each inner cavity. Details are not described herein.

Regardless of one or more inner cavities that a single housing includes in a filtering device, the pressing element, the cavity terminal, the fastening terminal, or the wiring port may be integrally formed with the housing. An advantage of the integral forming is that a grounding characteristic of the element, the terminal, or the port is good.

In some embodiments, the pressing element, the cavity terminal, the fastening terminal, or the wiring port is not integrally formed with the housing, for example, is connected to the housing by welding. An advantage of the non-integral forming is that replaceability of the element, the terminal, or the port is strong, that is, operability of changing a new replacement component is strong if there is damage.

The foregoing descriptions include merely some implementations in accordance with the disclosure, but are not intended to limit the protection scope of this application. Any variation or replacement readily figured out by a person skilled in the art within the technical scope disclosed shall fall within the protection scope of this application.

The invention claimed is:

1. A communication system comprising a filtering device, the filtering device comprising a housing, a resonant conductor, a pressing element and a fastening terminal:

the housing comprising an inner cavity accessible by an opening in the housing;

the resonant conductor disposed inside the inner cavity via the opening;

the pressing element having one end disposed on the housing and another end suspended and facing a position of an open-circuit end of the resonant conductor, the pressing element being configured such that a distance between the pressing element and the resonant conductor is changeable when the pressing element is pressed or drawn to adjust a resonant frequency;

the fastening terminal is disposed on an outer side of the housing and is configured to fasten the filtering device; and a cavity terminal integrated with the housing and configured to electrically connect a short circuit end of the resonant conductor to the housing and to support the resonant conductor when disposed inside the inner cavity.

2. The communication system according to claim 1, the inner cavity comprises one or more inner cavities, and the resonant conductor comprises one or more resonant conductors and at least one resonant conductor is disposed inside at least one of the inner cavities.

3. The communication system according to claim 1, the resonant conductor being disposed inside the inner cavity and is insert-able into and removable from the inner cavity, the resonant conductor being vertically or horizontally disposed inside the inner cavity.

4. The communication system according to claim 1, the resonant conductor being a metal strip, a microstrip, a strip line, or a printed circuit board (PCB).

5. The communication system according to claim 1, the pressing element being in the form of a metal sheet-shaped structure or a metal peg-shaped structure.

6. The communication system according to claim 1, the filtering device further comprising a wiring port disposed on an outer side of the housing and configured to connect to a wire.

7. The communication system according to claim 1, the pressing element being integrally formed with the housing; and the resonant conductor is vertically or horizontally insert-able into the inner cavity via the opening in the housing.

8. The communication system according to claim 1, the inner cavity comprises one or more inner cavities and the resonant conductor comprises a plurality of resonant conductors, at least two of the resonant conductors being disposed inside a same one of the one or more inner cavities and being electrically connected to each other.

9. The communication system according to claim 1, the communication system comprising a base station.

10. The communication system according to claim 1, the resonant conductor being removably disposed inside the inner cavity of the housing.

11. The communication system according to claim 1, further comprising a wiring port disposed on an outer side of the housing and configured to connect to a wire.

12. The communication system according to claim 1, the inner cavity comprises a plurality of inner cavities and the resonant conductor comprises a plurality of resonant conductors, the resonant conductors being positioned in the plurality of inner cavities and being electrically connected to each other.

13. The communication system according to claim 12, each resonant conductor of the plurality of resonant conductors being removably disposed inside a respective one of the inner cavities by inserting the resonant conductor vertically or horizontally into the respective one of the inner cavities via the housing.

* * * * *